US005718203A

United States Patent [19]

Shimada et al.

[11] Patent Number: 5,718,203

[45] Date of Patent: Feb. 17, 1998

[54] CONTROL APPARATUS FOR AN ENGINE OF DIRECT INJECTION

[75] Inventors: Kousaku Shimada; Yoshiya Takano; Masami Nagano, all of Hitachinaka, Japan

[73] Assignee: Hitachi, Ltd., Tokyo, Japan

[21] Appl. No.: 744,748

[22] Filed: Nov. 6, 1996

[30] Foreign Application Priority Data

Nov. 6, 1995 [JP] Japan ..... 7-287313

[51] Int. Cl.[6] ..... F02D 41/04; F02D 43/04

[52] U.S. Cl. ..... 123/425; 123/435

[58] Field of Search ..... 123/305, 425, 123/435

[56] References Cited

U.S. PATENT DOCUMENTS 5,156,126 10/1992 Ohkubo et al. ..... 123/425
5,222,481 6/1993 Morikawa ..... 123/435

FOREIGN PATENT DOCUMENTS 4-116243 4/1992 Japan .
5-79370 3/1993 Japan .

*Primary Examiner*—Tony M. Argenbright
*Attorney, Agent, or Firm*—Evenson, McKeown, Edwards & Lenahan, P.L.L.C.

[57] ABSTRACT

A control apparatus for a multi-cylinder engine of direct injection, is composed of a pressure change estimation part for estimating in advance the pressure in each cylinder, from the fuel injection start to the fuel injection end, a part for calculating the difference between the estimated pressure in the cylinder and the pressure of fuel, and a part for calculating a supposed decreased amount of injected fuel, caused by the decrease of the difference between the pressure in the cylinder and the pressure of fuel, in a compression stroke. A part for determining an additional fuel injection time interval to a base fuel injection time interval also determined by the control apparatus, compensates the supposed decreased amount of injected fuel.

10 Claims, 9 Drawing Sheets

CONTROL APPARATUS FOR AN ENGINE OF DIRECT INJECTION

BACKGROUND OF THE INVENTION

1. Field of the Invention

The present invention relates to a control apparatus for a gasoline engine of direct injection, particularly to an engine wherein fuel is directly injected into cylinders in a compression stroke in which the pressure in a cylinder is increasing.

2. Description of Related Art

As a gasoline engine wherein fuel is directly injected into cylinders, namely, a gasoline engine of direct injection, various types have been devised (for example, such a type as shown in JP-A-79370/1993). In a gasoline engine of direct injection (hereafter, referred to as just an engine), the fuel injection pressure is adjusted so as to keep the fuel pressure higher than the pressure in the cylinders.

In the process of fuel injection at a compression stroke, particularly continuing to the latter period of the compression stroke, in the above-mentioned existing engine of direct injection, the pressure in a cylinder increases as the pressure approaches the compression top dead center. Therefore the difference between the pressure in a cylinder and the fuel pressure, decreases as the pressure approaches the compression top dead center, and the pressure difference can not be kept constant. Further, the above-mentioned existing engine of direct injection has a problem in that, if fuel is injected in the latter period of the compression stroke, the injected fuel amount is less than the amount injected in the early period of the compression stroke, even for the same injection time, and the realized actual air/fuel ratio consequently becomes smaller than the target air/fuel ratio.

The countermeasures to the above-mentioned problem have been devised as follows.

(1) One engine control means is disclosed in JP-A-116243/1992, that is, an engine control means for detecting the pressure in each cylinder, determining the time interval of fuel injection, realizing the target fuel injection amount, by estimating an actually injected fuel amount, based on the difference between the detected pressure in the cylinder and the fuel pressure, in the preceding compression stroke, and opening an injector valve for the determined time interval in the successive compression stroke.

(2) Another engine control means is disclosed in JUM (Utility Model)-A-1837/1993, that is, an engine control means for estimating the intake air filling-up ratio into each cylinder, corresponding to operational states of the engine, detecting the pressure in the cylinder at the fuel injection time, based on the prepared curve of the compressed gas pressure versus the intake filling-up ratio, determining a correction factor for the injection time interval, based on the difference between the detected pressure in the cylinder and the fuel pressure, and correcting the injection time interval by multiplying the predetermined base injection time interval versus the fuel pressure by the determined correction factor.

The first engine control means controls an engine so that the actual air/fuel ratio is approximately equal to the target air/fuel ratio, by determining the time interval of fuel injection, realizing the target fuel injection amount by estimating an actually injected fuel amounts based on the difference between the detected pressure in the cylinder and the fuel pressure. However, the control means requires a pressure sensor in each cylinder for detecting the pressure in the cylinder in the preceding compression stroke. Further, in every time step $\Delta t$, two signals of the pressure in the cylinder and the fuel pressure are to be converted from analog to digital signals, and the corrected injection time interval corresponding to the target injection amount is to be calculated based on the calculated difference between the two digitized and memorized signals of the pressure in the cylinder and the fuel pressure. Thus, the engine control means has the following problem. That is, if the time step $\Delta t$ is large, the accurate corrected injection time interval can not be determined. On the contrary, if the time step $\Delta t$ is small, the calculation time of the corrected injection time impedes other control processing, which depends on the computing ability of the microcomputer being used.

The second engine control means corrects the injection time interval by multiplying the predetermined base injection time interval, corresponding to the fuel pressure, by the correction factor determined based on the difference between the detected pressure in the cylinder and the fuel pressure. However, the fuel pressure and the pressure in the cylinder are detected only at one point in time in the injection ending period. Therefore, the second engine control means has the following problem. That is, since the control means does not consider that the difference between the fuel pressure and the pressure in the cylinder decreases as the pressure in the cylinder approaches the compression top dead center, the corrected injection time interval (injection amount) is not accurately obtained in the control means.

SUMMARY OF THE INVENTION

An objective of the Invention:

The present invention has been accomplished in consideration of the above-described problems, and is aimed at providing an engine control apparatus capable of controlling a multi-cylinder engine of direct injection wherein fuel is directly injected into each cylinder of the engine, in a compression stroke, so that the actual air/fuel ratio is equal to the target air/fuel ratio.

Methods Solving the Problem:

To attain the above objective, the present invention provides a control apparatus for an engine of direct injection having means for detecting intake air flow into each of the cylinders, means for detecting the crank angle of each of the cylinders, means for compressing fuel and adjusting the pressure of fuel, means for detecting the opening of a throttle valve of each of the cylinders, means for determining a base fuel injection amount, based on the detected intake air flow, so as to realize the target air/fuel ratio, means for determining a base fuel injection time of each injector, including fuel injection start and end timings, corresponding to the determined base fuel injection amount, and means for controlling an ignition plug so as to ignite fuel at an ignition timing determined by the control apparatus, the controlling apparatus comprising:

a control unit for determining a new fuel injection time by correcting the determined base fuel injection time so that a supposed decreased amount of injected fuel, caused by a decrease of the difference between the pressure in each of the cylinders and the pressure of the fuel, in proportion to the approach to the compression top dead center, of the pressure in the cylinder, can be compensated, in a compression stroke.

Further, the control unit comprises pressure change estimation means for estimating in advance changes of the pressure in the cylinder, from the fuel injection start to the fuel injection end, means for calculating the difference between the estimated pressure in the cylinder and the pressure of fuel, means for calculating the supposed decreased amount of injected fuel, caused by the decrease of the difference between the pressure in the cylinders and the pressure of fuel, in the compression stroke, and means for determining an additional fuel injection time interval to the determined base fuel injection time to compensate the supposed decreased amount of injected fuel.

Further, the pressure change estimation means includes means for storing a standard waveform of changes of the normalized pressure in the cylinder during the whole compression stroke, which has a value of 1 at the top dead center, as a table expressed by values of changes in the normalized pressure versus crank angle changes, and means for calculating a pressure conversion coefficient to estimate the actual pressure in the cylinder by using the stored table, corresponding to the operational states of the engine, and the engine control unit estimates the actual pressure in the cylinder by multiplying the normalized pressure in the stored table by the calculated pressure conversion coefficient.

Further, the means for calculating a pressure conversion coefficient, includes means for storing the peak value of the pressure in the cylinder at the compression top dead center, assuming that fuel is not ignited in a compression stroke, as a map of the peak values expressed by two parameters of an engine revolutionary speed, and an engine load estimated by using an intake air flow and an engine revolutionary speed, and means for determining the peak value corresponding to an engine revolutionary speed obtained, based on the detected crank angle and the estimated engine load, by using the stored map.

Further, the means for calculating a pressure conversion coefficient, includes means for storing the peak value of the pressure in the cylinder at the compression top dead center, assuming that fuel is not ignited in a compression stroke, as a map of the peak values expressed by two parameters of an engine revolutionary speed and the opening of a throttle valve, and means determining the peak value corresponding to an engine revolutionary speed obtained, based on the detected crank angle, and the detected opening of a throttle valve, by using the stored map.

Further, the engine control unit corrects at least one of the fuel injection start timing and the ignition timing, corresponding to operational states of the engine.

Further, in the above mentioned control unit, operational states of the engine are detected as changes of a signal of the engine revolutionary speed.

Further, in the above mentioned control unit, operational states of the engine are judged based on the estimated engine load.

Furthermore, the present invention provides a method of operating a control apparatus for an engine of direct injection having means for detecting intake air flow into each of the cylinders, means for detecting the crank angle of each of the cylinders, means for compressing fuel and adjusting the pressure of fuel, means for detecting the opening of a throttle valve of each of the cylinders, means for determining base fuel injection amount, based on the detected intake flow, so as to realize the target air/fuel ratio, means for determining a base fuel injection time of each injector, including the fuel injection start and end timing, corresponding to the determined base fuel injection amount, and means for controlling an ignition plug so as to ignite fuel at an ignition timing determined by the control apparatus, the method comprising the steps of:

estimating in advance changes of the pressure in the cylinder, from the fuel injection start to the fuel injection end, calculating the difference between the estimated pressure in the cylinder and the pressure of fuel, calculating a supposed decreased amount of injected fuel, caused by the decrease of the difference between the pressure in the cylinder and the pressure of fuel, in a compression stroke, and determining an additional fuel injection time interval to the determined base fuel injection time to compensate the supposed decreased amount of injected fuel.

As mentioned above, by applying the present invention, the engine control by which the actual air/fuel ratio is almost equal to the target air/fuel ratio for an engine of direct injection, can be realized by the following control steps, that is, estimating in advance changes of the pressure in the cylinder from the fuel injection start to the fuel injection end, calculating the difference between the estimated pressure in the cylinder and the pressure of fuel, calculating the supposed decreased amount of injected fuel caused by the decrease of the difference between the pressure in the cylinders and the pressure of fuel in the compression stroke, and determining an additional fuel injection time interval to the determined base fuel injection time to compensate the supposed decreased amount of injected fuel.

DETAILED DESCRIPTION OF THE EMBODIMENTS

Figure 1:
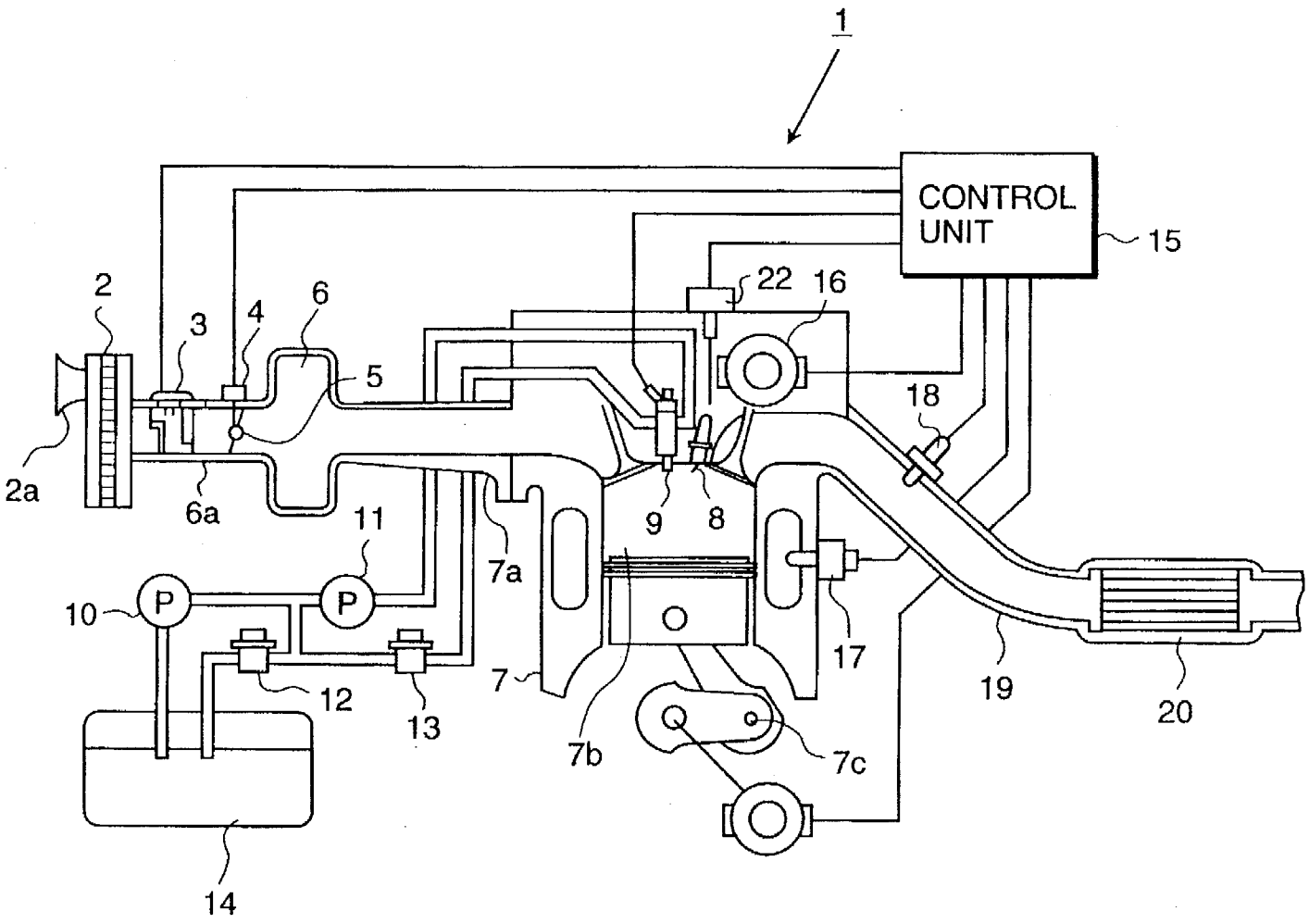
FIG. 1 shows a composition of an engine of direct injection having an engine control apparatus of an embodiment according to the present invention.

Hereinafter, details of the present invention will be explained with reference to embodiments shown in the drawings.

FIG. 1 shows a composition of an engine of direct injection having an engine control apparatus of an embodiment according to the present invention.

In a multi-cylinder engine 1 shown in FIG. 1, intake air is taken-in from an inlet part 2*a* of an air cleaner 2. The intake air passes a throttle body 6*a* in which a throttle valve 5 is installed, via an air flow meter 3, and enters into a collector 6. The intake air led to the collector 6, is distributed to intake pipes 7*a*, each of the pipes 7*a* being connected to each cylinders 7 in the engine 1, and led to a combustion chamber 7*b* of each cylinder 7.

Fuel such as gasoline receives a first pressurization conducted by the first fuel pump 10, in a fuel tank 14, and a second pressurization conducted by the second fuel pump 11. The pressurized fuel is fed to a fuel system of which each injector 9 is arranged in each cylinder. The fuel is pressurized by the first fuel pump 10 to a value, for example, 3 $kg/cm^2$, and kept constant by a fuel pressure regulator 12. Further, the fuel is again pressurized by the second fuel pump 11 to a value, for example, 30 $kg/cm^2$, being kept constant by a fuel pressure regulator 13, and injected into each cylinder 7 from the injector 9 installed in the cylinder 7.

A signal indicating the intake air flow, is output from the air flow meter 3, and input to a control unit 15.

Further, a throttle sensor 4 for detecting the opening of the throttle valve 5 is installed in the throttle body 6*a*, and an output signal of the throttle sensor 4 is also input to the control unit 15.

Further, a crank angle sensor 16 attached at each cam shaft (not shown in the figure), outputs a crank angle signal POS used for detecting the engine revolutionary speed (rpm) and a reference angle signal REF indicating the reference revolutionary position of a crank shaft 7*c*, and is input to the control unit 15. As a sensor for detecting the crank angle, a sensor of a crank angle sensor 21 type is also available.

An air/fuel (A/F) sensor 18 is attached at each exhaust pipe 19 for leading exhaust gas exhausted from each cylinder, and a signal output from the A/F sensor 18 is input to the control unit 15. A catalytic device 20 is installed at a place in the atmosphere side of the exhaust pipe 19, an ignition plug 8 is provided at a combustion chamber 7*c* of each cylinder 7, and is connected to a battery via an ignition coil 22.

Figure 2:
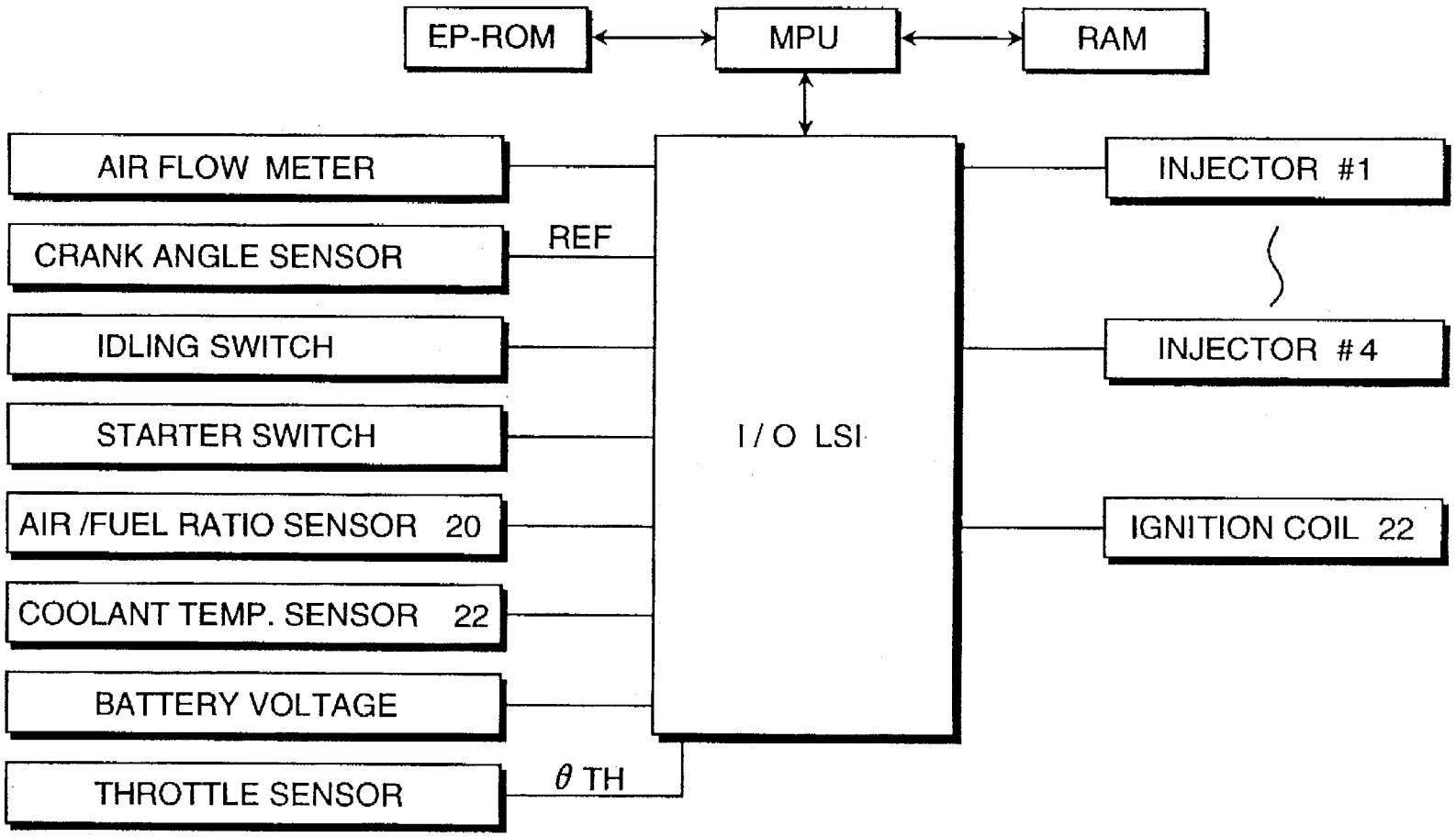
FIG. 2 is a conceptual composition diagram of the engine control apparatus shown in FIG. 1.

As shown in FIG. 2, a main part of the control unit includes an MPU, ROM, RAM, I/O LSI with an A/D converter, etc., and takes in signals from the above-mentioned various sensors for detecting operational states of the engine 1. Further, the control unit 15 executes calculation processes for generating various kinds of control signals for controlling a fuel amount to be injected and an ignition timing, and sends the generated control signals to devices arranged at each cylinder such as the injector 9, the ignition coil 22, and so forth.

Figure 3:
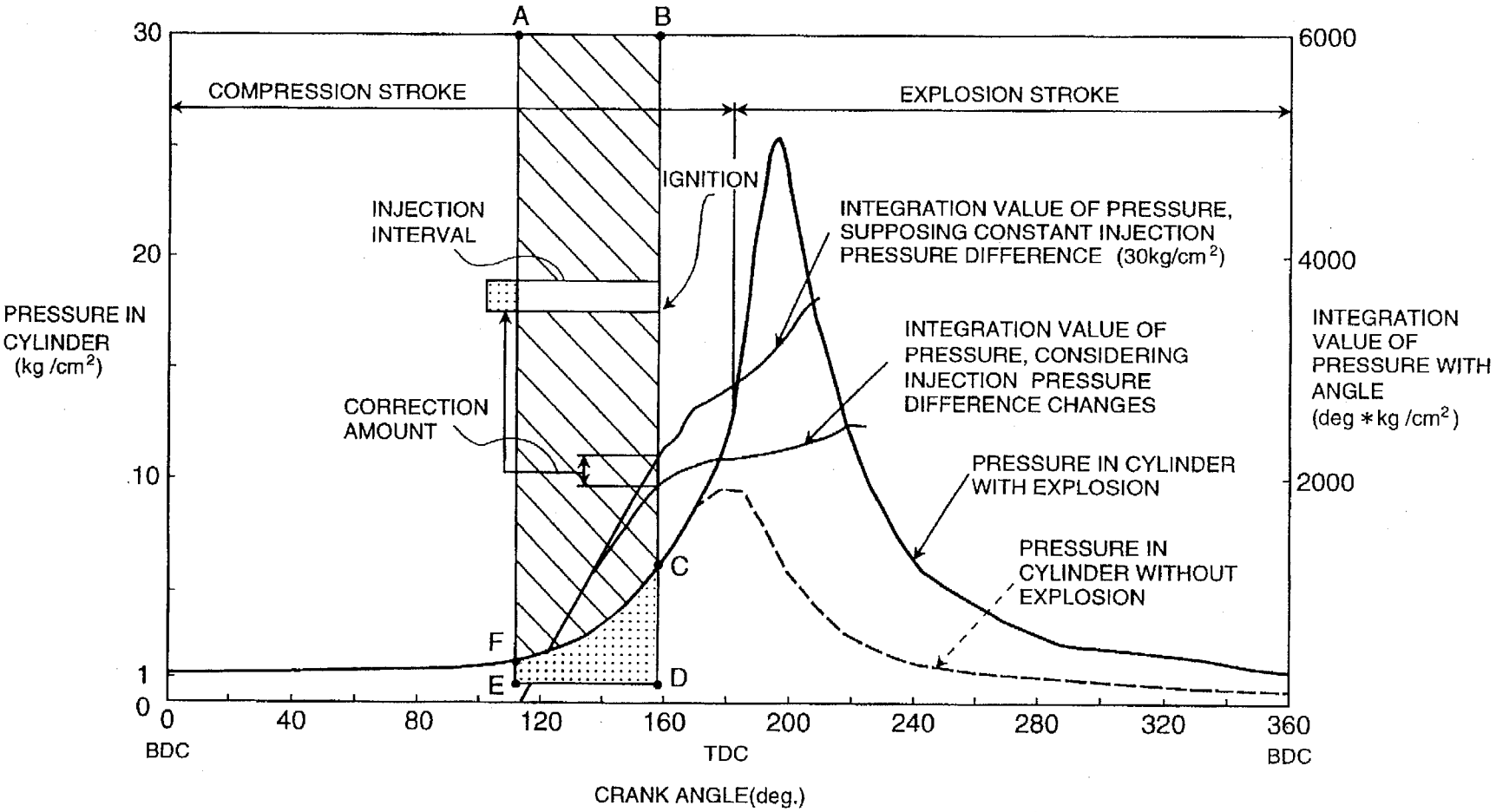
FIG. 3 is a graph showing changes of the pressure in a cylinder of the engine of direct injection, shown in FIG. 1.

FIG. 3 shows a relation between a correction amount of fuel injection and changes of the pressure in each cylinder when fuel is injected in a compression stroke for the above-mentioned multi-cylinder engine of direct injection, and the changes of the pressure in a cylinder are shown versus crank angle, during the interval from the start of a compression stroke to the end of an explosion stroke.

When the engine i is operated at a motoring operation state without explosion, as shown by a dotted line in FIG. 3, the pressure in the cylinder increases up to the pressure level corresponding to 180 deg. of crank angle, namely, TDC (Top Dead Center), taking the peak value, and continues to decrease down to the pressure level corresponding to BDC (Bottom Dead Center). A solid line curve in FIG. 3 shows changes of the pressure in the cylinder when fuel is ignited at a vicinity of the end in the compression stroke, rapidly increasing right after the ignition and decreasing after the pressure peak.

Although the pressure of the fuel secondly pressurized by the fuel pump 11, is adjusted by the regulator 13, to keep a constant pressure as shown by a line segment AB in FIG. 3, (for example, 30 $kg/cm^2$), the pressure in the cylinder changes as shown by a curve FC in FIG. 3. Therefore, the difference between the pressure in the high pressure region (at the side of the fuel system) and the pressure in the low pressure region (at the side of the cylinder), both of the regions being separated at the injector 9, decreases down as the crank angle proceeds toward 180 deg., as shown by a line segment AF or BC in FIG. 3. That is, even if fuel is injected for the same period (angle interval) shown by the line segment AB in a compression stroke, as in an intake stroke, the fuel amount injected in a compression stroke is less than the amount in an intake stroke. Quantitatively explaining, the fuel amount injected in an intake stroke is shown by the area of a figure ABCDEF, and the fuel amount injected in a compression stroke is shown by the smaller area a figure ABCF. Since the actual A/F ratio consequently becomes larger than the target A/F ratio, it is necessary to lengthen the fuel injection time by adding a correction amount to the base fuel injection time determined for fuel injection in an intake stroke. A method of obtaining the correction amount will be explained later.

Figure 4:
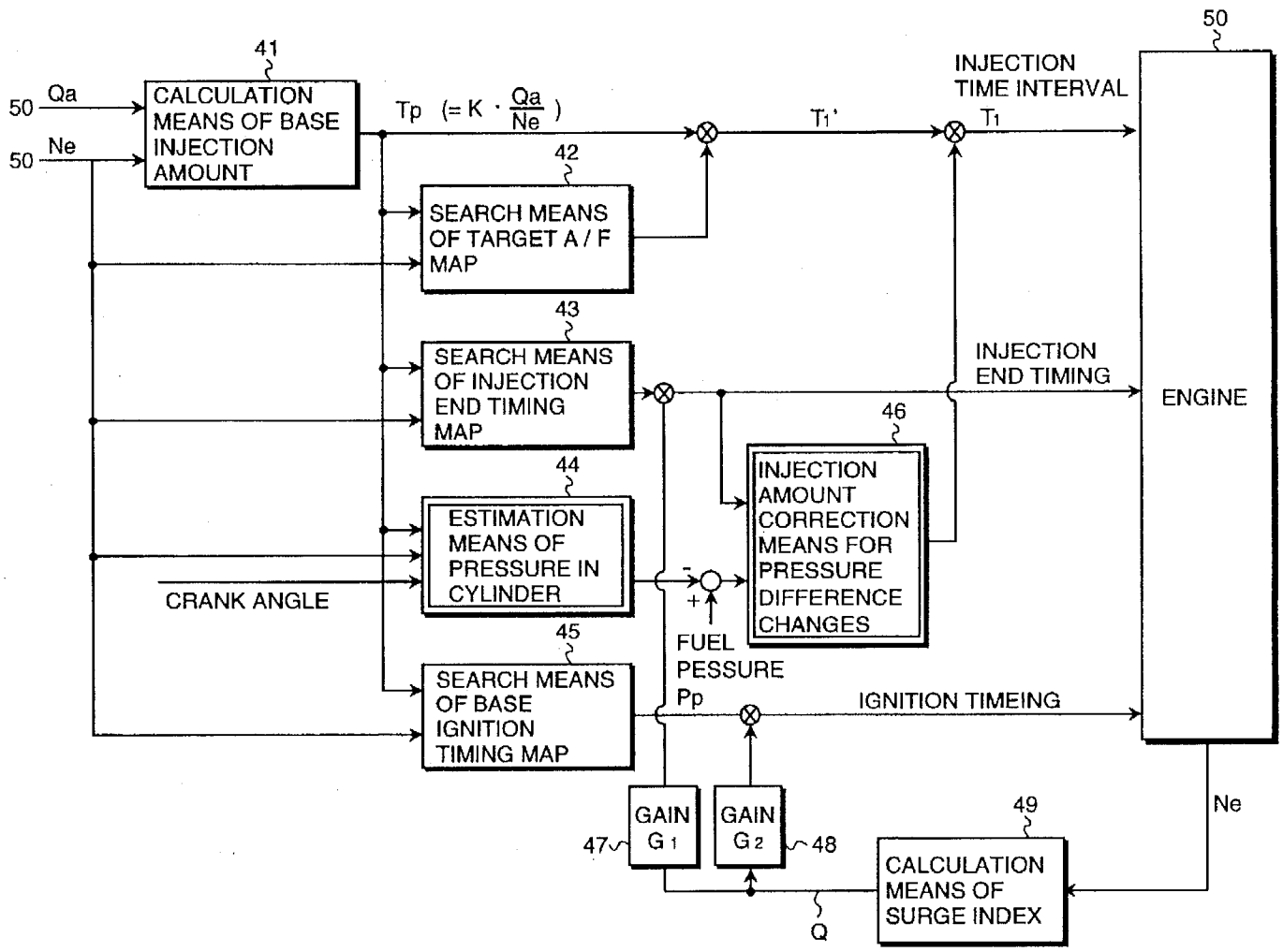
FIG. 4 is a functional block diagram of the engine control apparatus of the embodiment.

FIG. 4 shows a block diagram of the control apparatus for an engine of direct injection of the embodiment.

A base injection amount calculation means 41 obtains a base injection amount Tp, based on engine revolutionary speed Ne and intake air flow Qa, detected by the crank angle sensor 16 and the intake air flow meter 3, respectively. The time interval Ti of injecting fuel from the injector 9 is determined by multiplying the base injection amount Tp obtained by the base injection amount calculation means 41, by two coefficients. One of the coefficients is obtained by using a search means of a target A/F ratio map 42. Further, the target A/F ratio can be searched in a map in the search means of a target A/F ratio map 42 versus the two parameters of the revolutionary speed Ne and the base injection amount Tp.

The other of the coefficients is obtained by an injection amount correction means for pressure difference changes 46. This coefficient is one of the main features of the present invention, and is obtained, based on an injection end timing determined by using the pressure estimated by an estimation means 44 of the pressure in a cylinder and a search means of an injection end timing map 43 expressed with two parameters of the revolutionary speed Ne and the intake air flow Qa. A method of obtaining this coefficient will be explained in detail later, referring to FIGS. 5 and 6.

Figure 11:
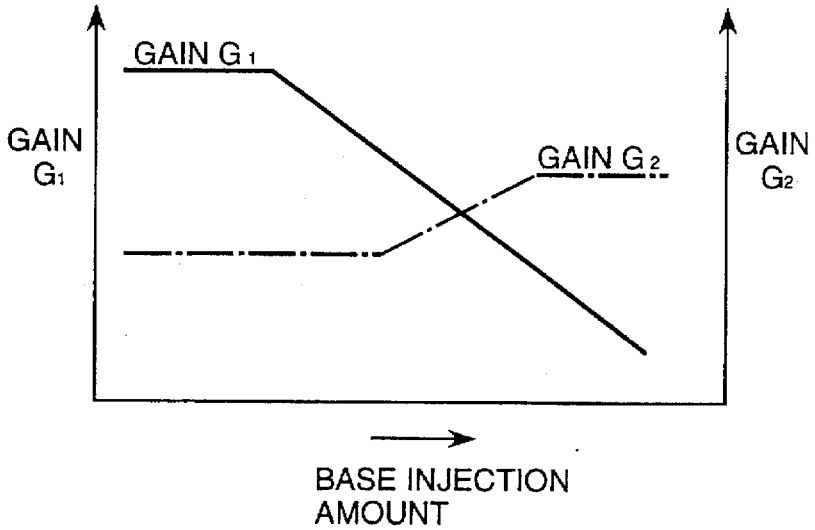
FIG. 11 is a graph showing contents of a table, in which two control gains of the engine control apparatus, for adjusting the injection timing and the ignition timing, are expressed, versus the base fuel injection amount.

A search means of a base ignition timing map 45 determines an ignition timing, based on the revolutionary speed Ne and the intake air flow Qa, and the determined ignition timing can be further corrected, corresponding to operational states of the engine. A surge index Q of the engine, one of indices indicating operational states of an engine, is obtained by a surge index calculation means 49 by using fluctuation components of a signal of the revolutionary speed Ne. If the stability of combustion in the engine degrades, which causes an increase of the surge index, the combustion in the engine is stabilized by adjusting the injection timing or the ignition timing. Correction amounts for the ignition timing and the injection timing are obtained in proportion to gains $G_1$ 47 and $G_2$ 48, respectively, which are stored as functions of the base injection amount corresponding to an engine load, respectively, as shown in FIG. 11. In the embodiment, the functions are expressed and stored as tables.

Figure 10:
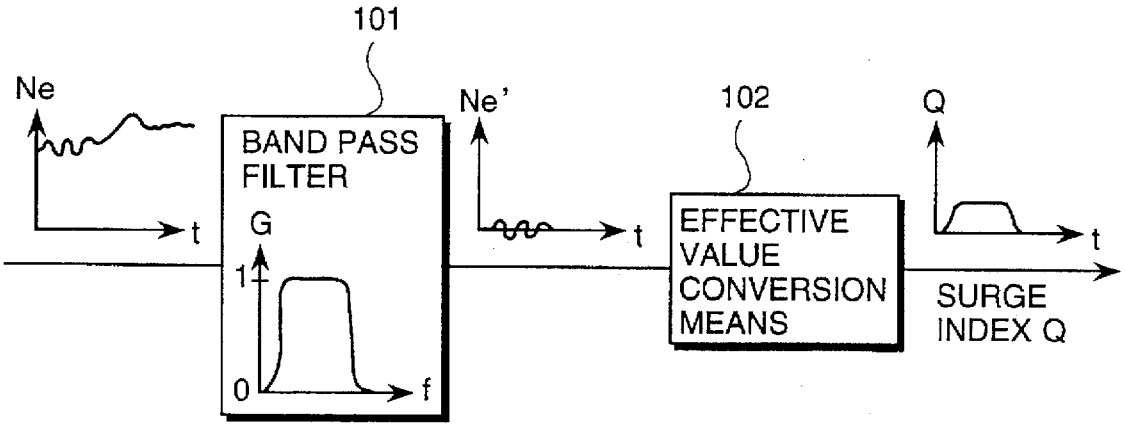
FIG. 10 is a functional block diagram of a surge index calculation means, showing the process of calculating the surge index.

A method of obtaining the surge index Q by using the surge index calculation means 49 shown in FIG. 4, is explained as follows, by referring to a composition block diagram shown in FIG. 10. At first, the revolutionary speed Ne is input to a band pass filter 101. If the transmission band of the filter 101 is set, for example, as a band of frequency 1 Hz–9 Hz, an output signal of the filter 101 has only components of the surge torque, which is converted to an effective value used as the surge index of the engine, by an effective value conversion means 102. Processing of the surge index is executed by a microcomputer in the control unit 15, in periodic time interruption or periodic revolution interruption.

In the following, operations of the estimation means of pressure in a cylinder 44 is explained in detail by referring to FIG. 5. First, a standard pressure change curve at operations without explosion, as explained in FIG. 3, is normalized by its peak value, as shown by a curve 501 in FIG. 5., and stored as a table of the normalized pressure versus crank angle. A curve 502 shows the actual pressure changes in the cylinder, which are estimated by multiplying the normalized curve 501 by a pressure conversion coefficient K. Since the pressure conversion coefficient K, namely, the peak value of the actual pressure in the cylinder, depends on operational states of the engine, the pressure conversion coefficient K is stored as a map of the coefficient K expressed with two parameters of the revolutionary speed Ne and the base injection amount Tp, or with two parameters of the revolutionary speed Ne and the opening $\theta_{TH}$ of the throttle valve.

Figure 5:
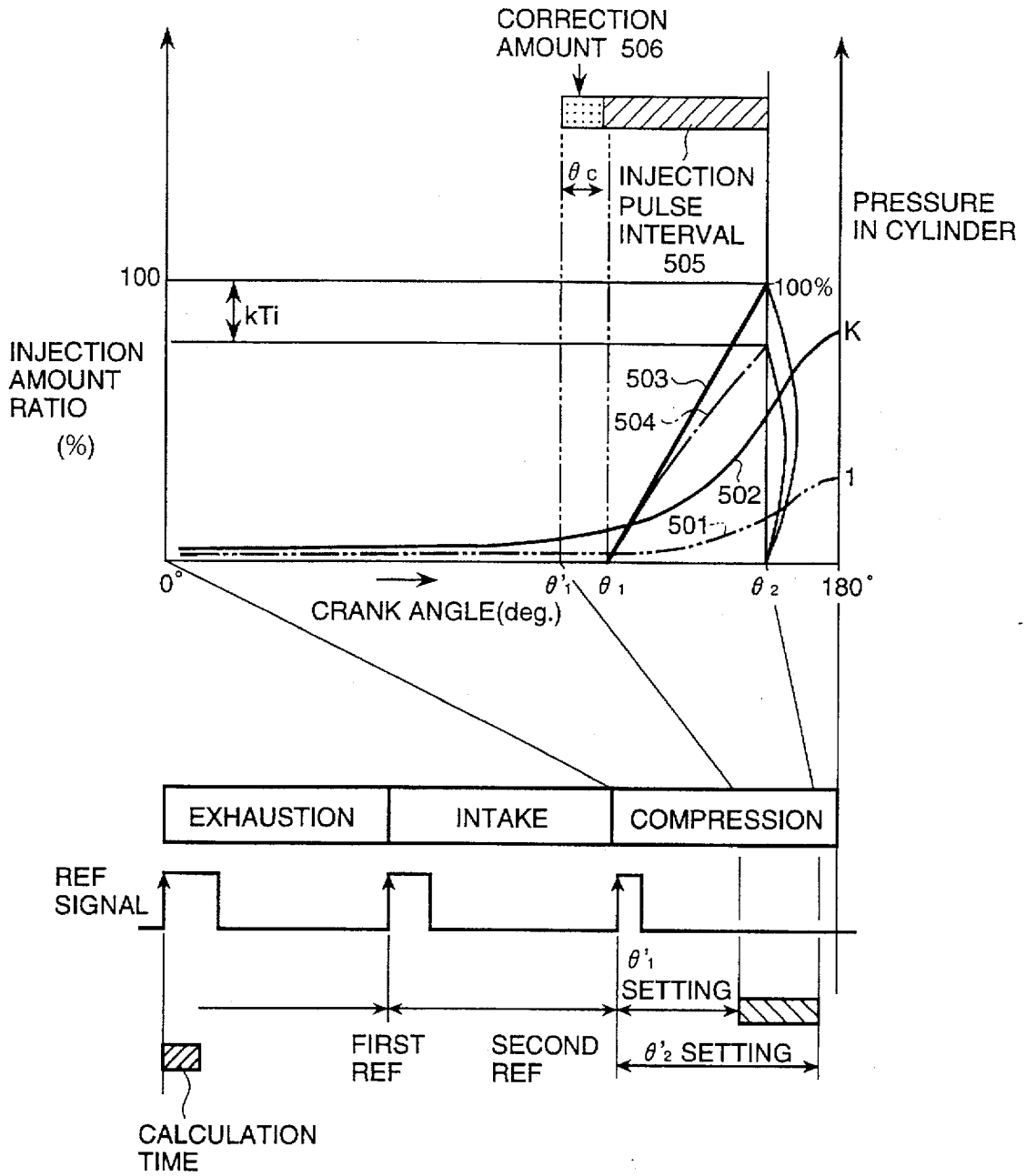
FIG. 5 is a time chart, in which time is expressed by changes of crank angle, showing operations of the engine control apparatus of the embodiment.

The operation of the injection time correction means for pressure difference 46 is explained in detail, also by referring to FIG. 5. A line 503 shows changes of the fuel injection amount ratio determined without considering the decrease of the pressure difference when injection is started at crank angle $\theta_1$, and ended at crank angle $\theta_2$. On the other hand, a line 504 shows changes of the fuel injection ratio, obtained while considering the decrease of the difference between the pressure of fuel and the obtained actual pressure change curve 502. Now, the value at the crank angle $\theta_2$, of the injection amount curve 503 obtained, supposing the constant pressure difference, is defined as 100%, and a short amount at the crank angle $\theta_2$, caused by the decrease of the pressure difference, in the injection amount curve 504, is expressed as KTi %. Thus, under the conditions of changing pressure difference, degradation of engine performance can be prevented by a correction means of the injection time interval, wherein a correction amount 506 of the injection time interval is added to the basic injection time interval 505 to be set under the conditions of constant pressure difference, the correction amount 506 being obtained by multiplying the basic injection interval 505 by a factor of KTi.

In the following, operations of the control apparatus for an engine of direct injection of the embodiment is explained, by referring to a flow chart shown in FIG. 6.

At first, the pressure conversion coefficient K is obtained by the estimation means of pressure in a cylinder 44, by searching the map of the peak pressure, with the determined base injection amount Tp and the detected revolutionary speed Ne, at step 601 of the flow chart. At step 602, the injection end timing $\theta_2$ is obtained by searching a map in the search means of an injection end timing map 43, with the determined base injection amount Tp and the detected revolutionary speed Ne. At step 603, the base injection start timing $\theta_1$ is calculated. The start timing $\theta_1$ is obtained by subtracting the injection time interval 505 from the injection end timing $\theta_2$.

Further, at step 604, the normalized pressure in the cylinder P(θ) is searched, and, at step 605, the ratio of the difference between the pressure of fuel and the actual pressure in the cylinder, is integrated. The integration is executed in the crank angle interval $\theta_1$–$\theta_2$, by repeating the judgment at step 606 and the process at step 607. The resultant amount of the integration, corresponds to the difference KTi between the injection amount 504 and the injection amount 503, at crank angle $\theta_2$ in FIG. 5. At step 608, the correction amount $\theta_c$ to the injection time interval 505, is obtained by multiplying the crank angle interval $\theta_1$–$\theta_2$, by KTi.

At last, the injection start timing is advanced from $\theta_1$ to $\theta_1'$, at step 609, and the processing of the flow chart ends.

Figure 6:
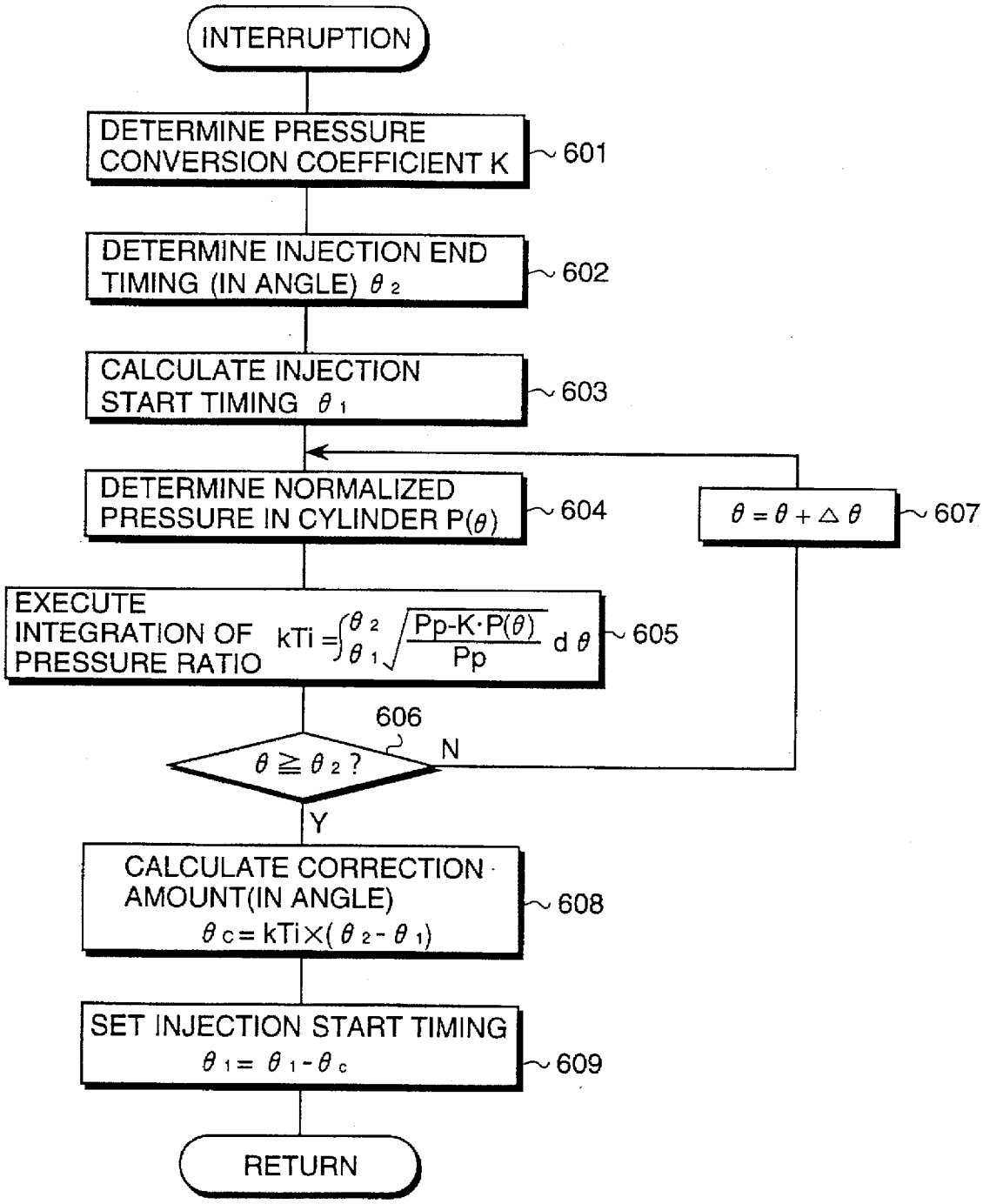
FIG. 6 is an example of a flow chart showing operations of the engine control apparatus of the embodiment.

The processing of the flow chart shown in FIG. 6 is finished in an exhaustion stroke preceding a compression stroke in which the results of the processing are actually executed, as shown at the bottom part of FIG. 5. That is, setting of the injection start timing $\theta_1'$ and the injection end timing $\theta_2$, is executed by regarding the REF secondly indicated from the end of the above-mentioned processing, as the origin of a time axis for setting the timings of $\theta_1'$ and $\theta_2$.

Figure 7:
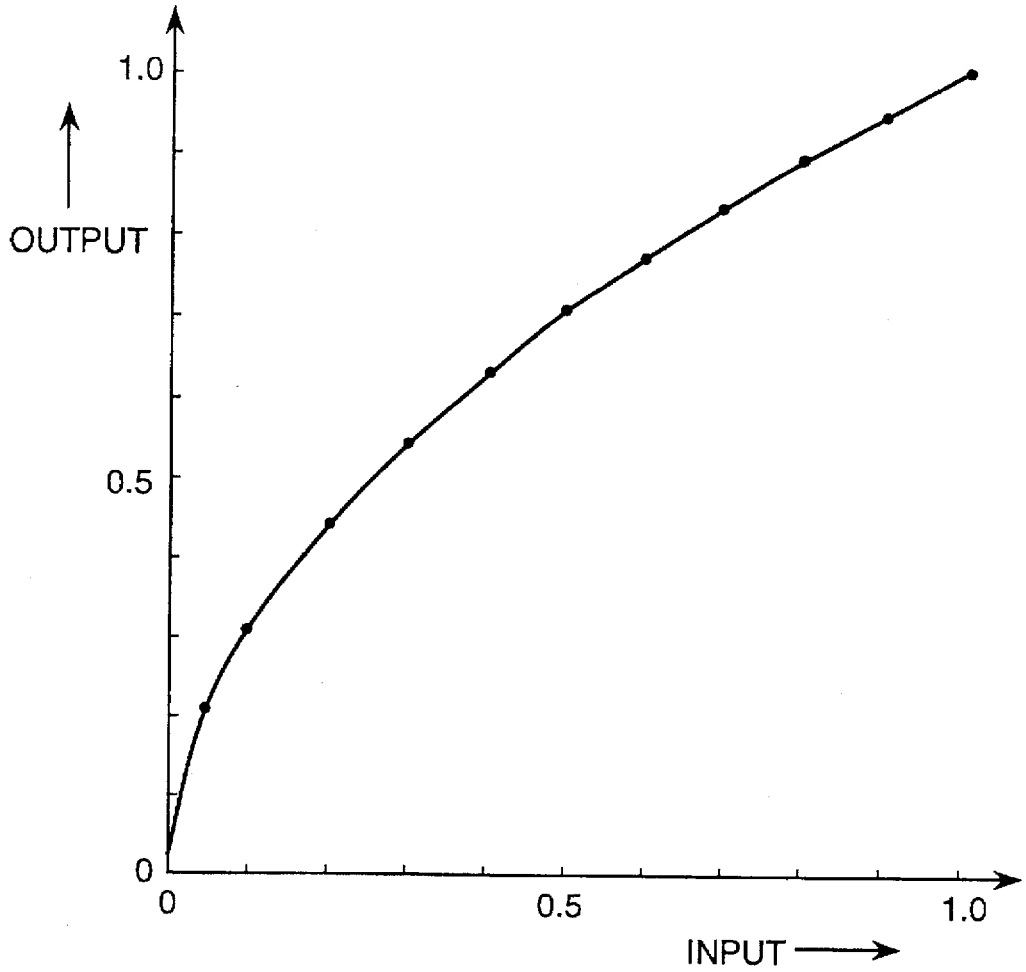
FIG. 7 shows the contents of a table used for the calculation of a square root, necessary for integration of the pressure ratio.
Figure 8:
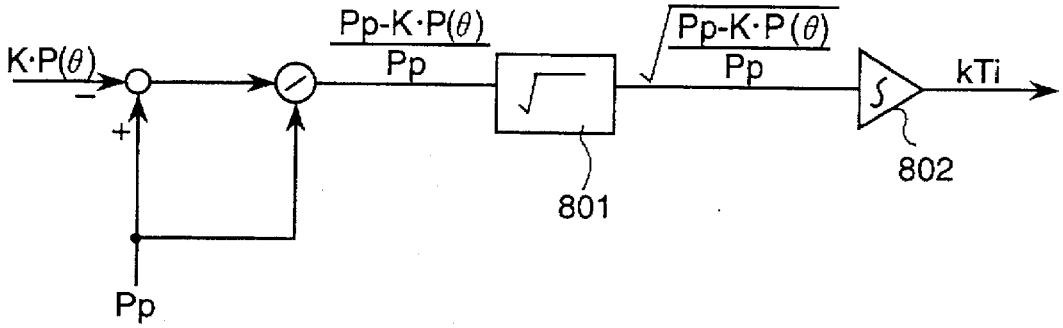
FIG. 8 is a block diagram showing processing steps of the integration of the pressure ratio.

At step 605 of the flow chart in FIG. 6, calculation of a square root is necessary in the integration of the ratio of the difference between the pressure of fuel and the actual pressure in the cylinder, to the pressure of fuel. If the computing ability of a microcomputer used in the control unit 15 does not have sufficient room for processing the flow chart in FIG. 6, it is effective to store the relation between values (outputs) of the square root and values of a variable interval 0–1 (inputs), shown by a curve in FIG. 7, as a table in a storage means in the microcomputer, and to obtain a necessary square root value by searching the table, versus a given input. The process at step 605 can be illustrated by a block diagram shown in FIG. 8, in utilizing the above-mentioned table for the square root calculation. After a variable of which the square root is to be calculated is obtained in advance, the square root versus the obtained variables is calculated by using the table expressing the curve shown in FIG. 7, at block 801, and the integration is executed at block 802.

Figure 9:
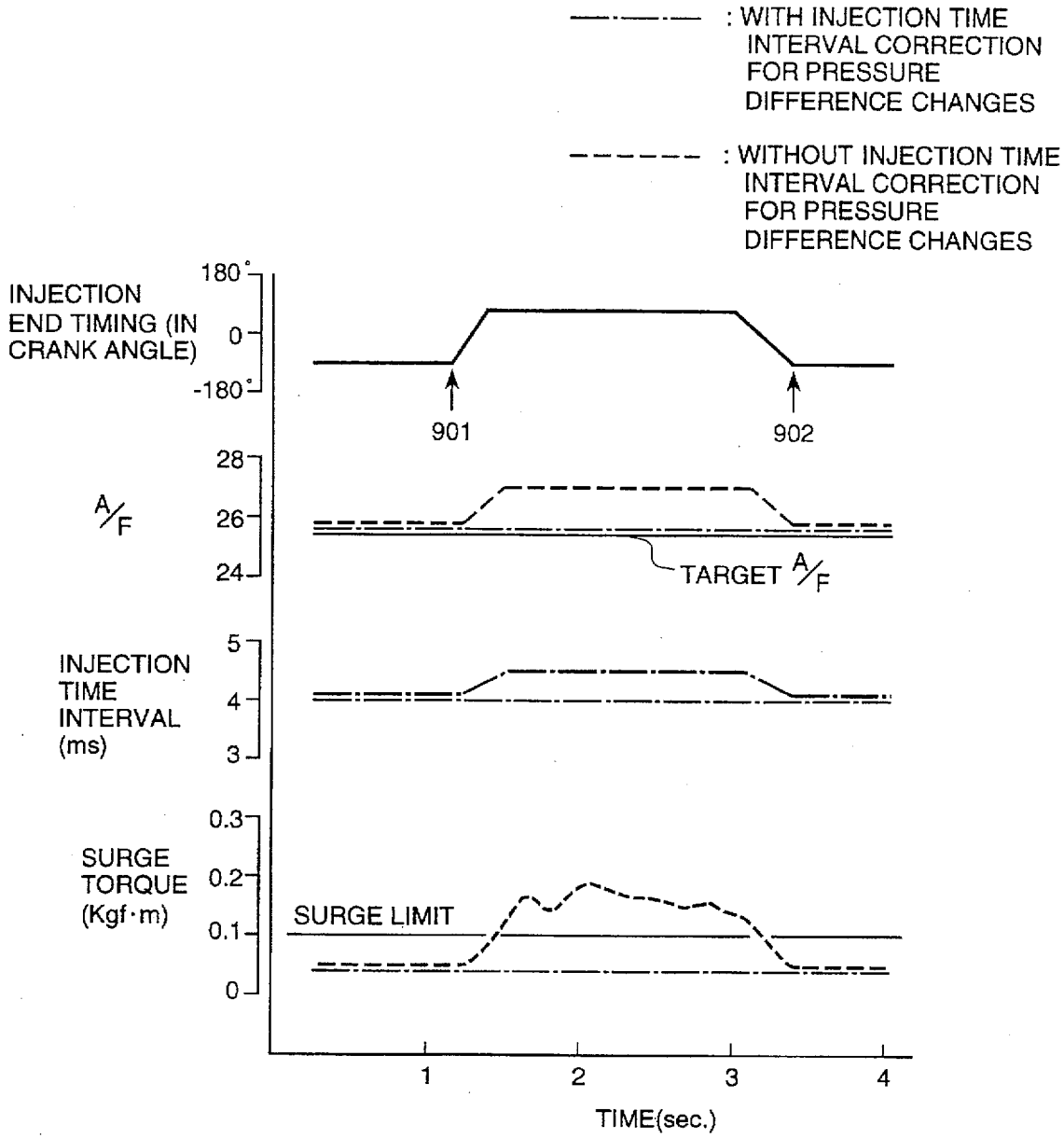
FIG. 9 illustrates graphs showing the comparison of performances of the engine between operations with the pressure difference correction and operations without the pressure difference correction.

FIG. 9 is a graph showing the comparison of performances of the engine between the operations with the injection time interval (corresponds to amount) correction for the pressure difference decrease, executed in the embodiment, and the operations without the injection time interval correction for the pressure difference decrease.

In FIG. 9, changes of operational parameters of the engine of direct injection 1 are shown, when the injection start timing is shifted to the latter period of a compression stroke, from the period of an intake stroke, during the interval of the time 901–the time 902. Dotted lines show changes of operational parameters at operations with the injection time interval correction for the pressure difference decrease, and dashed lines show the changes at operations with the constant injection time.

The figure shows that the surge torque of the engine 1 fluctuates beyond a surge limit, and performance of the engine 1 largely deteriorates, since the injection time interval is constant, and the A/F ratio becomes larger than the target A/F, when the injection time interval is not corrected even if the injection start timing is shifted to the half period of a compression stroke. On the other hand, since the injection time interval correction for the pressure difference decrease, in which the injection time interval is lengthened, is executed during the interval of the time 901–the time 902, in the embodiment, the actual A/F ratio does not shift from the target A/F ratio, and the surge torque does not increase, which secures the high performance of the engine 1.

The present invention is realized not only by the above-mentioned embodiments, but in various modes within the ranges to be claimed later.

As mentioned above, since the control apparatus for an engine of direct injection corrects the injection time interval by estimating the decreased amount of injection due to the decrease of the difference of the pressure of fuel and the pressure in each cylinder, and lengthening the injection time interval by the amount corresponding to the above-mentioned decreased amount of injection, so that the actual air/fuel ratio agrees with the target air/fuel ratio, the operational performance of the engine due to degradation of the actual air/fuel ratio can be prevented.

What is claimed is:

1. A control apparatus for a multi-cylinder engine of direct injection having means for detecting intake air flow into each cylinder, means for detecting the crank angle of each of said cylinders, means for compressing fuel and adjusting the pressure of fuel, means for detecting the opening of a throttle valve at each of said cylinders, means for determining base fuel injection amount, based on the detected air intake flow, so as to realize a target air/fuel ratio, means for determining a base fuel injection time interval of each injector, including fuel injection start and end timings, corresponding to the determined base fuel injection amount, and means for controlling an ignition plug so as to ignite fuel at an ignition timing determined by said controlling apparatus, said controlling apparatus comprising:

a control unit for newly determining a fuel injection time interval by correcting said determined base fuel injection time interval so that a supposed decreased amount of injected fuel, caused by a decrease of the difference between the pressure in each of said cylinders and the pressure of fuel, in proportion to an approach of the compression top dead center, of the pressure in said cylinder, is compensated, in a compression stroke.

2. A control apparatus according to claim 1, wherein said control unit includes pressure change estimation means for estimating in advance the pressure in the cylinder, from the fuel injection start to the fuel injection end, means for calculating the difference between said estimated pressure in the cylinder and the pressure of fuel, means for calculating a supposed decreased amount of injected fuel, caused by the decrease of the difference between the pressure in said cylinder and the pressure of fuel, in said compression stroke, and means for determining an additional fuel injection time interval to said determined base fuel injection time interval to compensate said supposed decreased amount of injected fuel.

3. A control apparatus according to claim 2, wherein said pressure change estimation means includes means for storing a standard waveform of changes in the normalized pressure in said cylinder during an entire compression stroke, which has a value of 1 at the top dead center, as a table expressed by values of changes in said normalized pressure versus crank angle changes, and means for calculating a pressure conversion coefficient to estimate the actual pressure in said cylinder by using said stored table, corresponding to operational states of said engine, and said engine control unit estimates the actual pressure in said cylinder by multiplying said normalized pressure in said stored table by said calculated pressure conversion coefficient.

4. A control apparatus according to claim 3, wherein said means for calculating a pressure conversion coefficient, includes means for storing the peak value of the pressure in said cylinder at the compression top dead center, assuming that fuel is not ignited in a compression stroke, as a map of peak values expressed by two parameters of an engine revolutionary speed, and an engine load estimated by using intake air flow and an engine revolutionary speed, and means for determining the peak value corresponding to an engine revolutionary speed obtained on a basis of said detected crank angle, and said estimated engine load, by searching said stored map.

5. A control apparatus according to claim 3, wherein said means for calculating a pressure conversion coefficient, includes means for storing the peak value of the pressure in said cylinder at the compression top dead center, assuming that fuel is not ignited in a compression stroke, as a map of peak values expressed by two parameters of an engine revolutionary speed and the opening of a throttle valve, and means for determining the peak value corresponding to an engine revolutionary speed obtained on the basis of said detected crank angle, and said detected opening of a throttle valve, by searching said stored map.

6. A control apparatus according to claim 1, wherein said engine control unit corrects at least one of said fuel injection start timing and said ignition timing, corresponding to operational states of said engine.

7. A control apparatus according to claim 6, wherein operational states of said engine are detected as changes of a signal of said engine revolutionary speed.

8. A control apparatus according to claim 6, wherein operational states of said engine are judged based on said estimated engine load.

9. A method of operating a multi-cylinder control apparatus for an engine of direct injection having means for detecting intake air flow into each of several cylinders, means for detecting the crank angle of each of said cylinders, means for compressing fuel and adjusting the pressure of fuel, means for detecting the opening of a throttle valve at each cylinder, means for determining a base fuel injection amount, based on said detected air intake flow, so as to realize the target air/fuel ratio, means for determining a base fuel injection time interval of each injector, including fuel injection start and end timings, corresponding to said determined base fuel injection amount, and means for controlling an ignition plug so as to ignite fuel at an ignition timing determined by said control apparatus, said method comprising the steps of:

estimating in advance changes of the pressure in said cylinder, from the fuel injection start to the fuel injection end, calculating the difference between said estimated pressure in said cylinder and the pressure of fuel, calculating a supposed decreased amount of injected fuel, caused by the decrease of the difference between the pressure in said cylinders and the pressure of fuel, in a compression stroke, and determining an additional fuel injection time interval to said determined base fuel injection time interval to compensate said supposed decreased amount of injected fuel.

10. A control system for a fuel-injected multi-cylinder engine, comprising:

an intake air flow sensor providing an air flow signal;

crank angle sensors providing a crank angle signal for each of said cylinders;

at least one fuel pump and at least one fuel pressure regulator which compresses and adjusts the pressure of a fuel;

throttle sensors providing a throttle valve output signal for each of said cylinders;

a control unit including a microprocessor programmed to perform the following:

determine a base fuel injection amount based on the air intake flow signal so as to realize a target air/fuel ratio;

determine a base fuel injection time interval for each fuel injector, including fuel injection start and end times, corresponding to the determined base fuel injection amount;

controlling an ignition plug so as to ignite fuel at an ignition timing determined by said control unit;

determining a new fuel injection time interval by correcting said determined base fuel injection time interval such that a supposed decreased amount of injected fuel caused by a decrease of the difference between the pressure in each of said cylinders and the pressure of the fuel, in proportion to an approach of a compression top dead center position, of the pressure in said cylinder, is compensated in a compression stroke.

* * * * *